US005763836A

United States Patent [19]

Anastasi et al.

[11] Patent Number: 5,763,836

[45] Date of Patent: Jun. 9, 1998

[54] RETRACTABLE MULTICONDUCTOR COIL CORD

[75] Inventors: James J. Anastasi, Windham; David O. Fundin, Plainfield, both of Conn.

[73] Assignee: C & M Corporation of Connecticut, Wauregan, Conn.

[21] Appl. No.: 492,970

[22] Filed: Jun. 21, 1995

[51] Int. Cl.[6] ..... H01B 7/06

[52] U.S. Cl. ..... 174/113 R; 174/69; 174/108

[58] Field of Search ..... 174/113 R, 113 C, 174/131 A, 69, 103, 108

[56] References Cited

U.S. PATENT DOCUMENTS

| | | | |
|---|---|---|---|
| 2,039,475 | 5/1936 | Campbell . | |
| 2,051,316 | 8/1936 | Shaw . | |
| 2,545,544 | 3/1951 | Doherty | 250/17 |
| 2,573,439 | 10/1951 | Henning | 174/69 |
| 2,764,625 | 9/1956 | Ingmanson | 174/69 |
| 3,048,078 | 8/1962 | Kaplan | 87/1 |
| 3,100,240 | 8/1963 | McKirdy | 174/69 |
| 3,126,442 | 3/1964 | Roberts | 174/69 |
| 3,240,867 | 3/1966 | Maddox | 174/69 |
| 3,246,075 | 4/1966 | Dansard | 174/69 |
| 3,274,329 | 9/1966 | Timmons | 174/69 |
| 3,299,375 | 1/1967 | Thompson | 333/96 |
| 3,318,994 | 5/1967 | Perrone et al. | 174/69 |
| 3,324,229 | 6/1967 | Ingmanson | 174/69 |
| 3,324,233 | 6/1967 | Bryant | 174/131 |
| 3,334,177 | 8/1967 | Martin | 174/106 |
| 3,453,374 | 7/1969 | Natwick | 174/69 |
| 3,584,139 | 6/1971 | Swanson | 174/103 |
| 3,594,491 | 7/1971 | Zeidlhack | 174/36 |
| 3,694,279 | 9/1972 | Rohrig et al. | 156/50 |

(List continued on next page.)

FOREIGN PATENT DOCUMENTS

| | | | |
|---|---|---|---|
| 682123 | 3/1964 | Canada . | |
| 1164898 | 10/1958 | France . | |
| 1230363 | 9/1960 | France | 174/69 |
| 649029 | 7/1937 | Germany | 174/69 |
| 2116364 | 10/1972 | Germany | 174/108 |
| 603122 | 3/1960 | Italy | 174/69 |
| 847383 | 9/1960 | United Kingdom . | |
| 950546 | 2/1964 | United Kingdom . | |

OTHER PUBLICATIONS

Low, Ernest F., "Brand–Rex Wire and Cable Engineering Guide", Publication WC–78, 1978, 38 pages.

"Military Specification Cable, Special Purpose, Electrical, Multiconductor", MIL–C–27072A(USAF), Jun. 21, 1965, 4 pages.

"Engineering Design Guide", 3rd Edition, C & M Corporation, 1992, 70 pages.

Insulation/Circuits "The ABC's of Electronic Retractile Cords" by Doug Duffield, Aug., 1976, pp. 23–27.

The International Institute of Connector and interconnection Technology, Inc., "Connectors and Interconnections Handbook" vol. 3—Wire and Cable, Sep. 1981, 4 pages.

*Primary Examiner*—Kristine L. Kincaid
*Assistant Examiner*—Chau N. Nguyen
*Attorney, Agent, or Firm*—Samuels, Gauthier, Stevens & Reppert

[57] ABSTRACT

A helical resiliently extensible and retractable multiconductor coil cord including a plurality of conductor components enclosed within an outer jacket. One of the conductor components includes a metallic conductor centrally disposed within and surrounded by a first dielectric material which in turn is centrally disposed within and surrounded by a metallic shield covered by an inner jacket. The other conductor components each include a metallic conductor covered by a second dielectric material. In one embodiment the metallic shield includes a plurality of sets of wires helically wrapped around the dielectric material in mutually opposing directions, at least one of the sets of wires being wrapped around the dielectric material at an angle of less than about 20 degrees with respect to the axis of the conductor.

12 Claims, 5 Drawing Sheets

U.S. PATENT DOCUMENTS

| | | | |
|---|---|---|---|
| 3,797,104 | 3/1974 | Pote | 29/593 |
| 3,823,253 | 7/1974 | Walters et al. | 174/69 |
| 3,843,361 | 11/1974 | Foster et al. | 49/167 |
| 3,848,361 | 11/1974 | Foster et al. | 49/167 |
| 3,854,002 | 12/1974 | Glander et al. | 174/69 |
| 3,993,860 | 11/1976 | Snow et al. | 174/69 |
| 4,131,757 | 12/1978 | Felkel | 174/107 |
| 4,408,089 | 10/1983 | Nixon | 174/34 |
| 4,552,989 | 11/1985 | Sass | 174/103 |
| 4,638,114 | 1/1987 | Mori | 174/36 |
| 4,683,349 | 7/1987 | Takebe | 174/69 |
| 4,719,319 | 1/1988 | Tighe, Jr. | 174/103 |
| 4,719,320 | 1/1988 | Strait, Jr. | 174/106 R |
| 4,738,734 | 4/1988 | Ziemek | 156/53 |
| 4,758,685 | 7/1988 | Pote et al. | 174/29 |
| 4,852,964 | 8/1989 | Holland et al. | 350/96.23 |
| 4,861,945 | 8/1989 | Buck et al. | 174/69 |
| 4,945,191 | 7/1990 | Satsuka et al. | 174/69 |
| 4,988,833 | 1/1991 | Lai | 174/69 |
| 5,212,350 | 5/1993 | Gebs | 174/102 R |

RETRACTABLE MULTICONDUCTOR COIL CORD

BACKGROUND OF THE INVENTION

The invention relates generally to retractable coil cords, and in particular relates to resiliently extensible and retractable multiconductor coil cords.

Conventional retractable coil cords generally employ heat settable materials for providing retractability. Heat settable materials generally include thermoplastics and thermosets. The cord is wrapped into a helical shape around a mandrel and heat is applied to set the material. The cord is then cooled and retains its helical shape due to the properties of the heat settable material. The helix of the coil may then be reversed to position the cord in a state of constant torsional tension. The retractability is generally also provided by thermoplastic and/or thermoelastomeric materials which typically form the outer jacket of the coil cord.

In conventional multiconductor coil cords the electrical conductors contribute little or no retraction force and are conventionally preferred to be as flexible as possible. Multiconductor coil cords having a relatively large amount of conductive material (e.g., metal) generally require a large amount of heat settable material. It is typically desirable however to minimize the diameter of the cord as well as the diameter of the helix formed by the cord, yet provide sufficient retraction.

Moreover, in many applications it is desirable to include a coaxial conductor within the coil cord to provide a variety of capabilities such as electromagnetic shielding. The use of coaxial cables in retractable cords presents several difficulties. First, the increased mass of conductor material generally either detracts from the cord's retractability (or snappiness), or requires that the cord be relatively large in cord diameter and/or helix diameter. Second, certain conventional coaxial shields tend to have relatively fragile mechanical properties (leading to kinking and distortion of the shield) which adversely affect their electrical characteristics of the coax. Specifically, as the cord is extended and retracted, the capacitance between the inner conductor and the shield varies causing signal transmission problems, particularly for signals having frequencies over 100 MHz.

U.S. Pat. No. 4,861,945 discloses that although single layer spiral shields and braided shields are problematic when used in retractable coil cords, coaxial cables having reverse spiral shields are suitable for use in coil cords. The mutually reversed spiral layers of the shield are taught in U.S. Pat. No. 4,861,945 to be wrapped around the coaxial insulator in the conventional manner for forming reverse spiral shields for coaxial cables. Reverse spiral shields are typically wrapped around the primary insulator of the coax cable at an angle between about 30 to 50 degrees with respect to the central conductor. The wires of a braided shield are typically wrapped at an angle between about 20 and 40 degrees with respect to the central conductor. Coaxial cables having braided shields are generally known to be less flexible than those having reverse spiral shields. It is known that a relatively low angle of wrap reduces the flexibility of the coax cable, while a relatively large angle of wrap makes it difficult for certain shields (e.g., braided shields) to be terminated by a cable termination technician since the shield cannot be easily pushed back onto itself. Conventional coil cords including coaxial cables generally require a relatively large amount of heat settable material to overcome the inelastic properties of the conductor materials. Further, the usable extension range of such retractile cords has been found to be unacceptably limiting.

It is an object of the invention to provide a retractile cord having a relatively small amount of heat settable material with respect to the amount of conductive material, and yet having optimal performance characteristics.

It is a further object of the invention to provide a retractile cord having a coaxial cable component suitable for use with high frequency signals, and being capable of withstanding repeated extension cycles through a substantial extension range.

SUMMARY OF THE INVENTION

It has been discovered that by selective use of proper non-conductive materials and by employing a shield in accordance with the invention, coil cords having coaxial components may be formed that have retraction characteristics superior to those of conventional shields yet include a relatively large amount of conductive material for their size.

In particular, the invention provides a helical resiliently extensible and retractable multiconductor coil cord comprising a plurality of conductor components enclosed within an outer jacket. One of the conductor components includes a metallic conductor centrally disposed within and surrounded by a first dielectric material which in turn is centrally disposed within and surrounded by a metallic shield covered by an inner jacket. The other conductor components each include a metallic conductor covered by a second dielectric material. In one embodiment the metallic shield includes a plurality of sets of wires helically wrapped around the dielectric material in mutually opposing directions, at least one of said sets of wires being wrapped around said dielectric material at an angle of less than about 20 degrees with respect to the axis of the conductor. In other embodiments the ratio of the sum of the cross sectional areas of the first and second dielectric materials and the inner and outer jackets with respect to the sum of the cross sectional areas of the metallic conductors and the metallic shield is less than about 20.

BRIEF DESCRIPTION OF THE DRAWINGS

The following description of the invention may be further understood with reference to the accompanying drawings in which.

DETAILED DESCRIPTION OF THE PREFERRED EMBODIMENT

Figure 1:
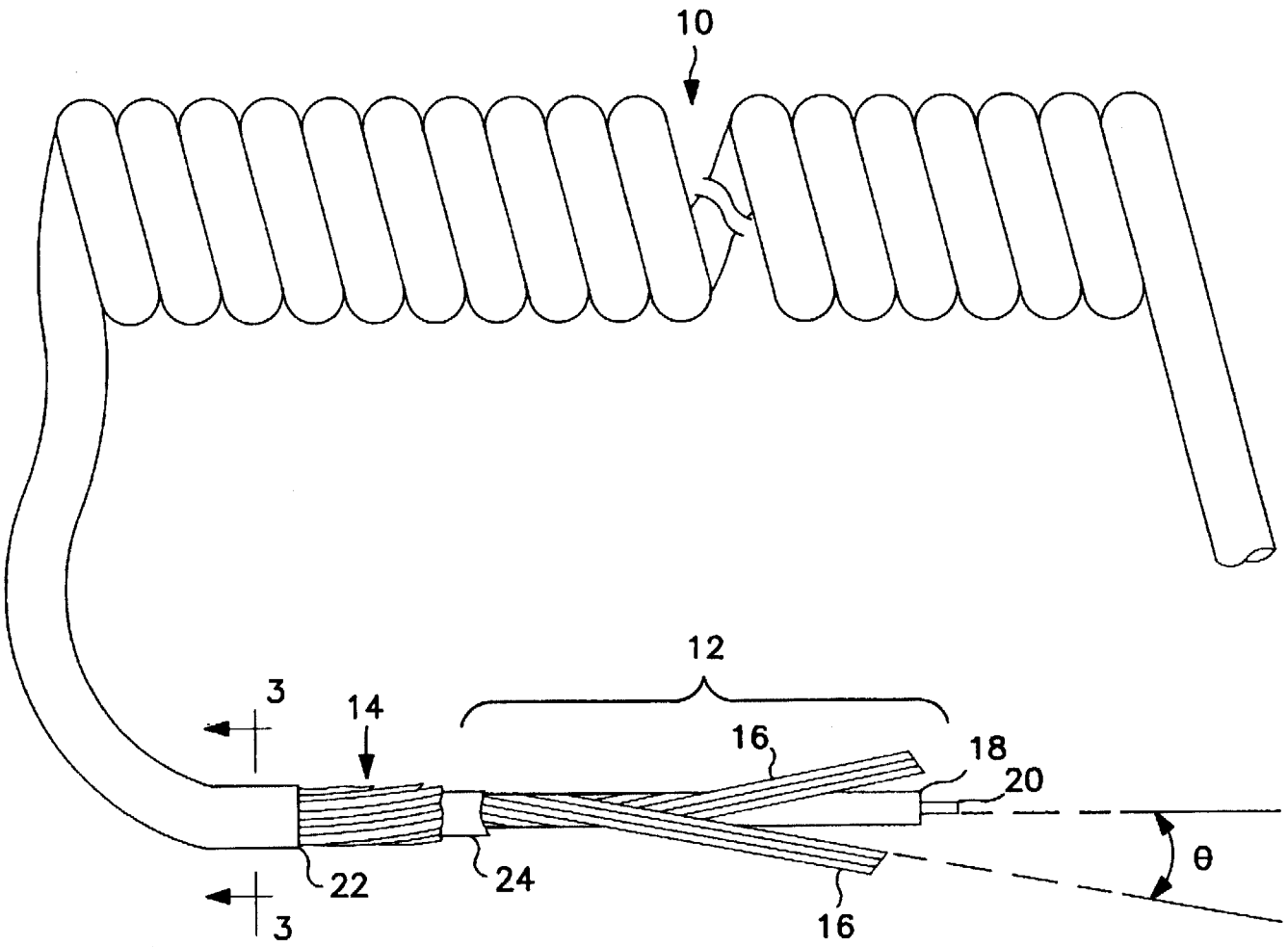
FIG. 1 is a diagrammatic view of a coil cord of the invention.

As shown in FIG. 1 a coil cord 10 of the invention includes a coaxial component 12 and a plurality of additional conductor components 14. The coaxial component 12 in the embodiment shown includes a pair of reverse spiral layers of wire 16 wrapped around the primary insulator 18 at an angle θ in the range of 10 to 20 degrees, and is preferably in the range of about 12 to 15 degrees (e.g., 13.5), with respect to the axis of a central conductor 20. It has been discovered that the decrease in flexibility of the wire shield as a result of this relatively low angle of wrapping does not detract from the performance of the coil cord, particularly when used in a coil cord having the preferred non-conductive materials as discussed below. The performance of the coil cord is believed to be governed principally by the stiffness or set provided by certain of the non-conductive materials, as well as the retractability or snappiness provided by the same or other non-conductive materials within the cord. It has been discovered that although flexibility is a significant factor in designing non-retractable cables, it is not as significant a factor in designing retractable coil cords. In fact, coil cords achieving the objectives of the invention may be made from multiconductor cable assemblies that are rather stiff.

Further, it is believed that the low angle of shield wrapping actually improves the usable extension range of the coil cord. The conductive elements of the coil cord that are formed of twisted bundles (e.g., the discrete conductor elements of 14a, 14b and 20 shown in FIGS. 3A–3C), as well as the wrapping of the conductor components 14 around the coax itself, are all preferably twisted or wrapped in the rotational direction that maximizes the usable extension range of the coil cord, i.e., in the direction of the helix of the coil cord. One of the sets of wires used in the coax shield must be wrapped in the opposite (or wrong) direction. It has been discovered that employing a low angle of shield wrapping reduces the extent to which the wrong direction portion of the shield detracts from the usable extension range of the coil cord.

Figure 2:
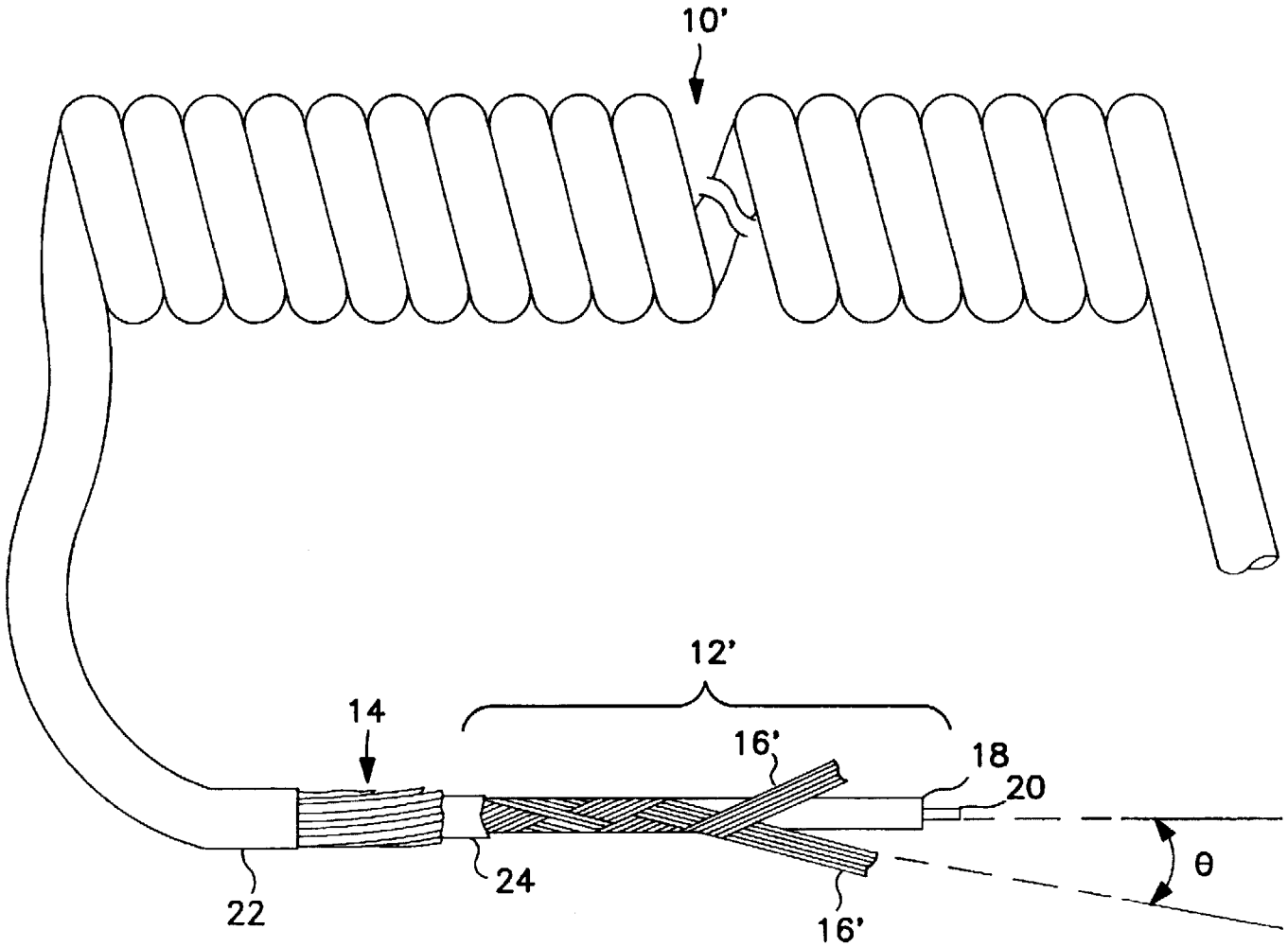
FIG. 2 a diagrammatic view of another embodiment of a coil cord of the invention.

As shown in FIG. 2 where like reference numbers designate elements corresponding to those in FIG. 1, another embodiment of the invention 10' includes a coaxial component 12' having a braided shield 16'. The braid strands are laid at an angle of between 13 and 14 degrees with respect to the central conductor. In each embodiment the shield wires are wrapped around the primary insulator using a plurality of carriers, at least one of which is positioned to wrap the shield wires in a direction opposite the others. For example, eight carriers may be used for each of the two wrap directions, and each carrier may carry eight wires. The wires are alternately crossed in making the braided shield.

The primary insulator 18 used for the coaxial component 12 may be formed of solid or foam material such as polyethylene, polypropylene, or polytetrafluoroethylene (PTFE), and is preferably formed of solid fluorinated ethylene propylene (FEP). The dielectric insulator used for the additional conductor components 14 may be formed of polypropylene, polyethylene, polyvinylchloride, or polytetrafluoroethylene (PTFE), and is preferably formed of a thermoplastic co-polyester elastomer such as HYTREL® co-polyester elastomer as sold by the E. I. duPont de Nemours & Company, Inc., Wilmington, Del. The outer jacket 22 may be formed of polyurethane or any elastomeric material and is preferably formed of a polyether block amide such as PEBAX® thermoplastic elastomer as sold by Atochem of Glen Rock, N.J. The HYTREL® material is believed to contribute optimal stiffening by virtue of its ability to easily take and hold a set position, and the PEBAX® material is believed to contribute optimal retraction or snappiness due to its elastic charateristics. The area between the various components shown in FIG. 3A may be either empty or is preferably filled with filler material such as cotton thread and/or paper to permit the coil cord to have as round a shape as possible. In a preferred embodiment the coil cord includes a tissue tape encircling the cord between the conductor components 14 and the inner surface of the outer jacket 22. The tissue tape is used to facilitate stripping the jacket during termination. The conductors may be made of copper which may be plated with tin or silver. Examples of coil cords made in accordance with the invention follow.

EXAMPLE A

Figure 3A:
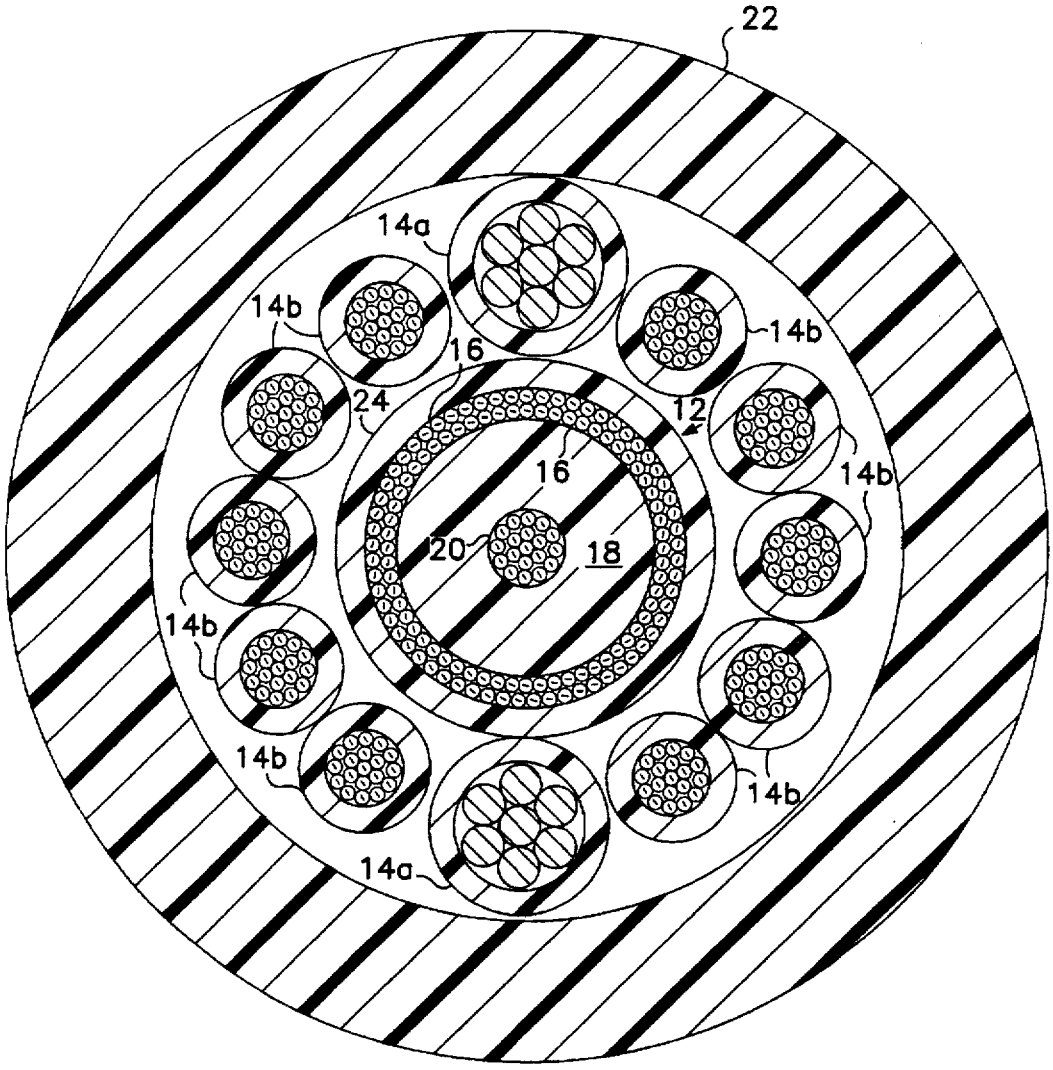
FIGS. 3A–3C are cross-sectional views of various embodiments of the invention taken along line 3—3 of FIG. 1.

The first example is shown in FIG. 3A and includes a coaxial component 12, two conductor components 14a of approximately 24 AWG, ten conductor components 14b of approximately 28 AWG, and an outer jacket 22.

The coaxial component includes a central conductor 20, a primary insulator 24, a conductive shield 16 and a jacket 26. The central conductor 20 includes nineteen 40 AWG wires. Forty gauge (40 AWG) wire has a diameter of 0.0031 inches. The shield 16 may be either a reverse spiral shield or a braided shield and includes two sets of 44 AWG wires wrapped around the primary insulator at approximately 13.5 degrees with respect to the axis of the central conductor. Forty four gauge (44 AWG) wire has a diameter of 0.0020 inches. Each of the sets of wires is wrapped as eight units (or bunches) of eight wires, and therefore includes 64 wires around the cord in cross-section as shown. The inner and outer diameters of the primary insulator are 0.0155 inches and 0.045 inches respectively. The inner and outer diameters of the coax jacket are 0.055 inches and 0.065 inches respectively.

The 24 AWG conductor components 14a are each formed of seven 32 AWG wires surrounded by an electrical insulator. Thirty two gauge (32 AWG) wire has a diameter of 0.0080 inches, and the insulator has inner and outer diameters of 0.024 inches and 0.035 inches respectively. The 28 AWG conductor components 14b are each formed of nineteen 40 AWG wires surrounded by an electrical insulator having inner and outer diameters of 0.0155 inches and 0.024 inches respectively. The outer jacket 22 has inner and outer diameters of 0.132 inches and 0.190 inches respectively. The coil cords of Example A were formed on a mandrel having a diameter of 5/16 inch, and the resulting coil cords typically have a helix outer diameter of about 11/16 inch.

The cross-sectional areas of various elements of the retractable coil cord of Example A are compiled in Table 1. The areas are calculated from the diameters ($A=\pi(d/2)^2$). Certain of the non-conductive materials may either compress slightly at points of contact or become displaced when the components are combined in the final coil cord product. Also, since the conductors may be bunch stranded in the form of a spiral as is conventional, the cross-sections may be very slightly non-orthogonal to the axis of cord itself. The following calculations however assume that the cross-sectional areas of the materials shown in FIG. 3A are perfectly round.

A useful ratio is analyzing such coil cords is the ratio of the cross-sectional area of the heat settable materials (the insulation and jacketing) to the cross-sectional area of the conductive materials (the conductors and shield). Conventional coil cords have insulation and jacket to conductor ratios of about 29 and above. It is an objective of the invention to provide a coil cord having as low an insulation and jacket to conductor ratio as possible yet achieve sufficient retractability.

TABLE 1

| | Approximate Cross-Sectional Area of Conductive Material (in Sq. Inches) | Approximate Cross-Sectional Area of Insulation And Jacket Materials (in Sq. Inches) |
|---|---|---|
| Coaxial component | 19 strands of 40 AWG (d = .0031") wire + 2 × 64 strands of 44 AWG (d = .0020") wire = .0001434 + .0004021 => 0.0005455 | Insulation: OD (d = .045"), ID (d = .0155") + Jacket: OD (d = .065"), ID (d = .055") = |

TABLE 1-continued

| | Approximate Cross-Sectional Area of Conductive Material (in Sq. Inches) | Approximate Cross-Sectional Area of Insulation And Jacket Materials (in Sq. Inches) |
|---|---|---|
| | | .001402 + .0009425 => 0.0023445 |
| 2 × 24 AWG component | 2 × 7 × 32 AWG (d = .0080") wire => 0.0007037 | Insulation: OD (d = .035"), ID (d = .024") => 0.00050972 |
| 10 × 28 AWG component | 10 × 19 × 40 AWG (d = .0031") wire => 0.001434 | Dielectric: OD (d = .024"), ID (d = .0155") => 0.00026368 |
| Outer Jacket | | OD (d = .190"), ID (d = .132") => 0.014668 |
| Total: | 0.0026832 | 0.017786 |

The insulation and jacket to conductor ratio of the coil cord of Example A is 0.017786/0.0026832=6.629. It is also an objective to provide a coil cord having as much conductor cross sectional area with respect to total area as possible. The total cross sectional conductor area per total area is 0.0026832/0.028352=0.094638=9.5%. Coil cords made in accordance with the above described embodiment of Example A have been proven to satisfy the requirement that the coil cord return to within 10% of its original length after having been stretched one thousand times to 3 times its original length.

Coil cords of Example A have also been tested for attenuation and impedance. Three 7.5 foot samples were tested with a 900 MHz signal after various numbers of extensions for attenuation (loss) and impedance as follows:

TABLE 2

| Sample No. | Number of Extensions | Attenuation (dB) | Impedance (Ohms) |
|---|---|---|---|
| 1 | 0 | 2.795 | 48.56 |
| | 1,000 | 2.86 | 48.09 |
| | 21,800 | 2.88 | 49.23 |
| | 43,000 | 2.86 | 48.17 |
| 2 | 0 | 2.926 | 47.33 |
| | 1,000 | 2.97 | 47.67 |
| | 21,800 | 2.91 | 47.71 |
| | 43,000 | 2.94 | 47.91 |
| 3 | 0 | 3.046 | 48.59 |
| | 1,000 | 2.954 | 48.45 |
| | 21,800 | 2.84 | 48.46 |
| | 43,000 | 2.85 | 48.24 |

Even after 43,000 extensions each of the three samples exhibited virtually no change in either attenuation or impedance. The samples were also tested for changes in attenuation and impedance while the samples were being extended and retracted, and there were no such changes measured.

EXAMPLE B

Figure 3B:
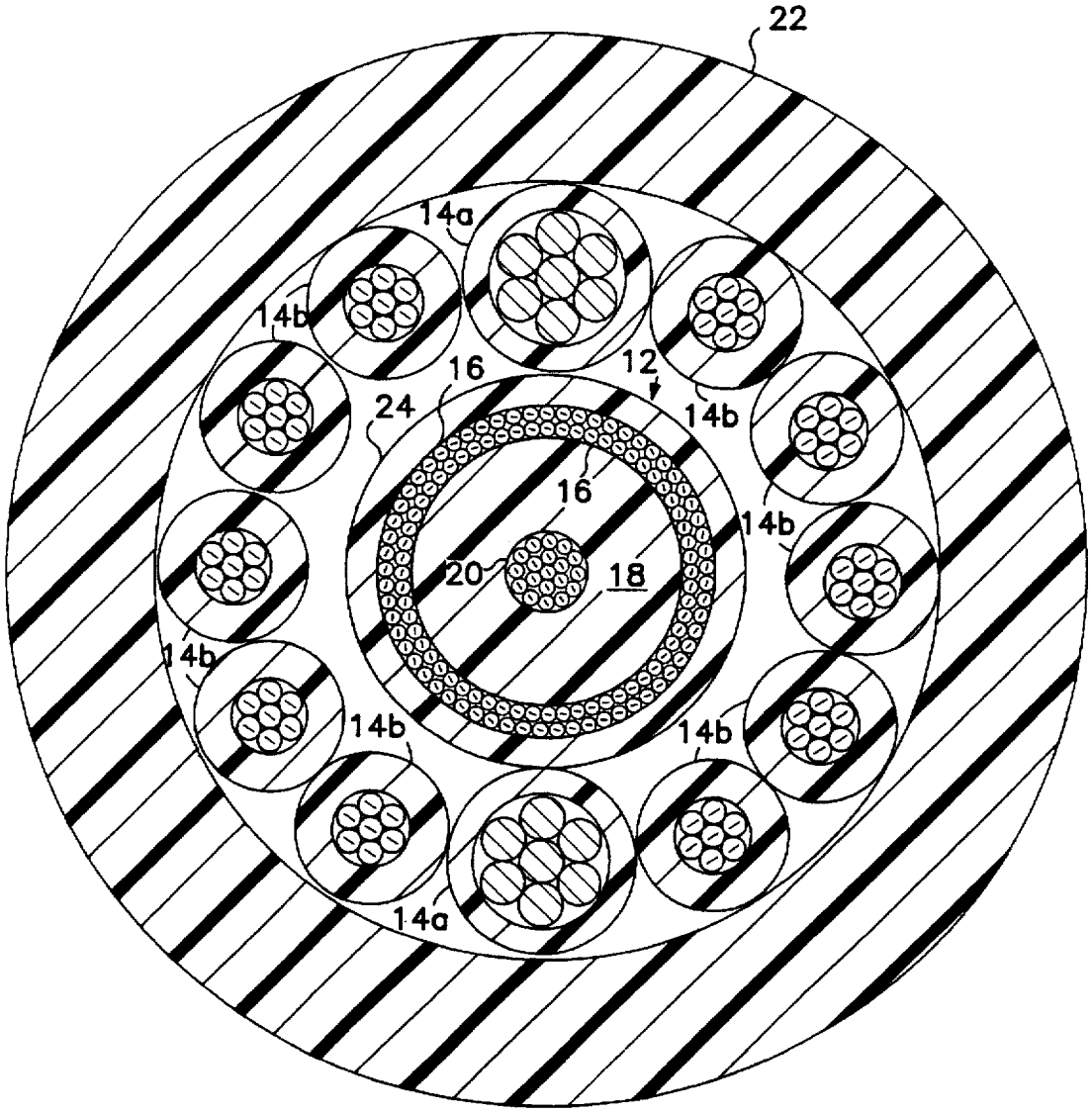

The second example is shown in FIG. 3B and includes a coaxial component 12, two conductor components 14*a* of approximately 24 AWG, ten conductor components 14*b* of approximately 30 AWG, and an outer jacket 22. The coaxial component 12 and the 24 AWG components 14*a* are the same as the ones used in Example A. The 30 AWG components 14*b* are each formed of seven 38 AWG wires surrounded by an electrical insulator having inner and outer diameters of 0.012 inches and 0.026 inches respectively. Thirty eight gauge (38 AWG) wire has a diameter of 0.0040 inches. The outer jacket 22 has inner and outer diameters of 0.132 inches and 0.187 inches respectively.

TABLE 3

| | Approximate Cross-Sectional Area of Conductive Material (in Sq. Inches) | Approximate Cross-Sectional Area of Insulation And Jacket Materials (in Sq. Inches) |
|---|---|---|
| Coaxial component | 19 strands of 40 AWG (d = .0031") wire + 2 × 64 strands of 44 AWG (d = .0020") wire = .0001434 + .0004021 => 0.0005455 | Insulation: OD (d = .045"), ID (d = .0155") + Jacket: OD (d = .065"), ID (d = .055") = .001408 + .0009425 => 0.0023442 |
| 2 × 24 AWG component | 2 × 7 × 32 AWG (d = .0080") wire => 0.0007037 | Insulation: OD (d = .035"), ID (d = .024") => 0.00050972 |
| 10 × 30 AWG component | 10 × 7 × 38 AWG (d = .0040") wire => 0.00087964 | Insulation: OD (d = .026"), ID (d = .012") => 0.00041783 |
| Outer Jacket | | OD (d = .187"), ID (d = .132") => 0.0013779 |
| Total: | 0.0015833 | 0.014707 |

The ratio of the cross-sectional area of the insulation and jacket materials with respect to the cross-sectional area of the conductive materials is 0.014707/0.0015833=9.289. The total cross sectional conductor area per total area is 0.0015833/0.027464=0.05765=5.8%.

EXAMPLE C

Figure 3C:
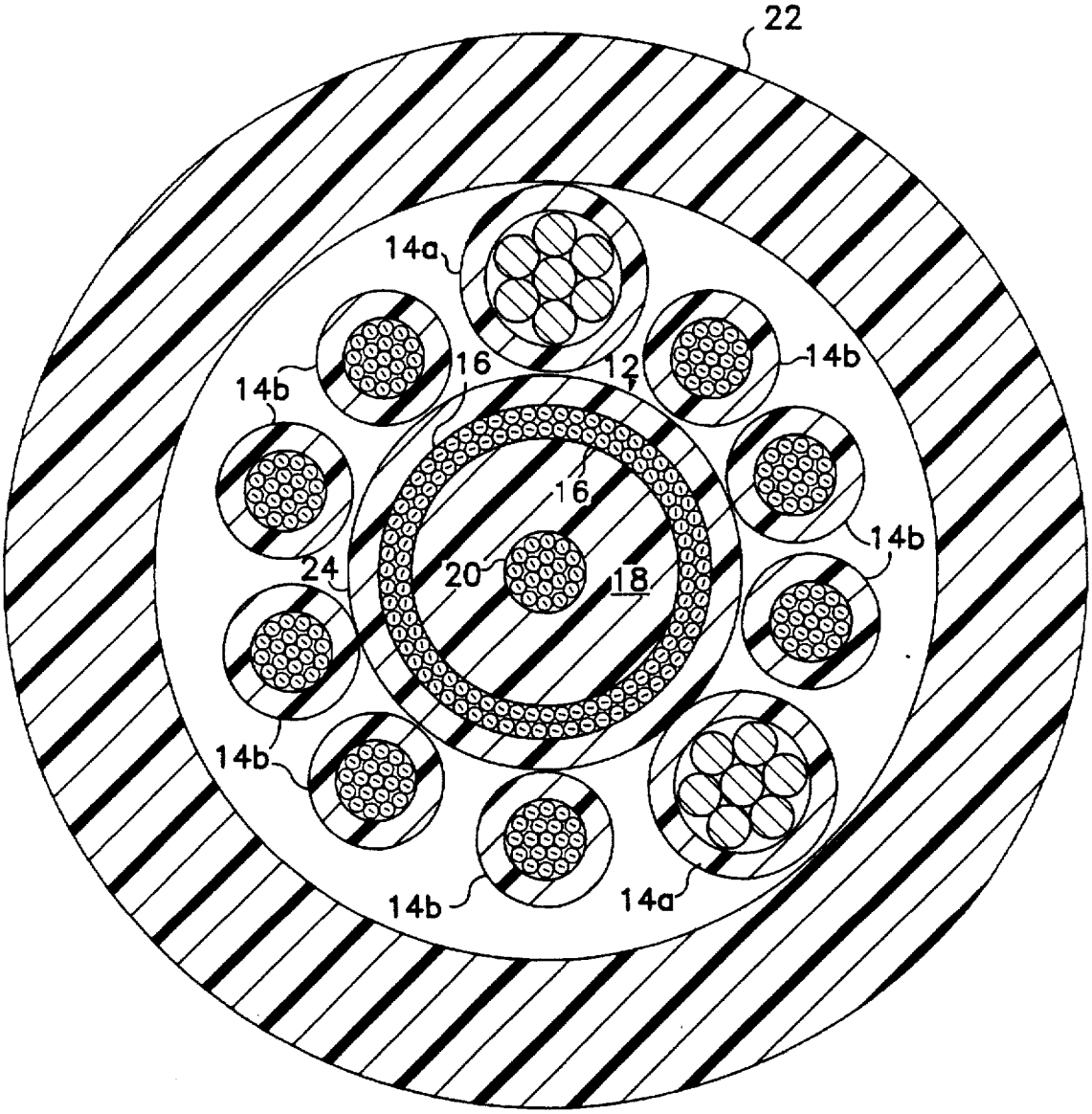

The third example is shown in FIG. 3C and includes a coaxial component 12, two conductor components 14*a* of approximately 24 AWG, eight conductor components 14*b* of approximately 28 AWG, and an outer jacket 22. The components 12, 14 are the same as the ones used in Example A. The outer jacket 22 has inner and outer diameters of 0.129 inches and 0.170 inches respectively.

TABLE 4

| | Approximate Cross-Sectional Area of Conductive Material (in Sq. Inches) | Approximate Cross-Sectional Area of Insulation And Jacket Materials (in Sq. Inches) |
|---|---|---|
| Coaxial component | 19 strands of 40 AWG (d = .0031") wire + 2 × 64 strands of 44 AWG (d = .0020") wire = .0001434 + .0004021 => 0.0005455 | Insulation: OD (d = .045"), ID (d = .0155") + Jacket: OD (d = .065"), ID (d = .055") = .001408 + .0009425 => 0.0023442 |
| 2 × 24 AWG component | 2 × 7 × 32 AWG (d = .0080") wire => 0.0007037 | Insulation: OD (d = .035"), ID (d = .024") => 0.00050972 |

TABLE 4-continued

| | Approximate Cross-Sectional Area of Conductive Material (in Sq. Inches) | Approximate Cross-Sectional Area of Insulation And Jacket Materials (in Sq. Inches) |
|---|---|---|
| 8 × 28 AWG component | 8 × 19 × 40 AWG (d = .0031") wire => 0.0011472 | Insulation: OD (d = .024"), ID (d = .0155") => 0.00026369 |
| Outer Jacket | | OD (d = .170"), ID (d = .129") => 0.0096281 |
| Total: | 0.0023964 | 0.012745 |

The ratio of the cross-sectional area of the insulation and jacket materials with respect to the cross-sectional area of the conductive materials is 0.012745/0.0023964=5.318. The total cross sectional conductor area per total area is 0.0023964/0.027464=0.087254=8.7%. Coil cords made in accordance with the above described embodiment of Example C have been proven to satisfy the requirement that the coil cord return to within 10% of its original length after having been stretched one thousand times to 3 times its original length.

Coil cords of the invention including reverse spiral shields or braided shields are particularly well suited for use with cellular telephones since the coax component may serve as the antenna for the cellular phone thus eliminating the need for an additional antenna component. The additional conductor components within the coil cord may be used for power as well as switch (or button) information signals.

Those skilled in the art will appreciate that numerous modifications and variations may be made to the above disclosed embodiments without departing from the spirit and scope of the invention.

What is claimed is:

1. A helical resiliently extensible and retractable multi-conductor coil cord comprising:

a plurality of conductor components enclosed within an outer jacket, one of said conductor components including a metallic conductor along a conductor axis surrounded by a dielectric material which in turn is surrounded by a metallic shield covered by an inner jacket;

said metallic shield including a plurality of sets of wires helically wrapped around said dielectric material in mutually opposing directions, at least one of said sets of wires being wrapped around said dielectric material at an angle of about 20 degrees or less with respect to the axis of said conductor.

2. A coil cord as claimed in claim 1, wherein both of said sets of wires are each wrapped around said dielectric material in mutually opposing directions at an angle of between about 10 to 20 degrees with respect to the axis of said conductor.

3. A coil cord as claimed in claim 2, wherein said sets of wires are each wrapped around said dielectric material in mutually opposing directions at an angle of between about 12 to 15 degrees with respect to the axis of said conductor.

4. A coil cord as claimed in claim 1, wherein said sets of wires form a reverse spiral shield.

5. A coil cord as claimed in claim 1, wherein said sets of wires form a braided shield.

6. A helical resiliently extensible and retractable multi-conductor coil cord comprising:

a plurality of conductor components enclosed within an outer jacket, one of said conductor components including a metallic conductor along a conductor axis surrounded by a first dielectric material which in turn is surrounded by a metallic shield covered by an inner jacket, and other of said conductor components each including a metallic conductor covered by a second dielectric material;

said metallic shield including a plurality of sets of wires helically wrapped around said first dielectric material in mutually opposing directions at angles of about 20 degrees or less with respect to the axis of said conductor.

7. A coil cord as claimed in claim 6, wherein the ratio of the sum of the cross sectional areas of said first and second dielectric materials and said inner and outer jackets with respect to the sum of the cross sectional areas of said metallic conductors and said metallic shield being about 20 or less.

8. A coil cord as claimed in claim 6, wherein said outer jacket includes a polyether nylon blocked amide, and said second dielectric material includes a thermoplastic co-polyester elastomer.

9. A helical resiliently extensible and retractable multi-conductor coil cord comprising:

a plurality of conductor components enclosed within an outer jacket comprising a polyether nylon blocked amide;

one of said conductor components including a metallic conductor along a conductor axis surrounded by a first dielectric material which in turn is surrounded by a metallic shield covered by an inner jacket, said metallic shield including a plurality of sets of wires helically wrapped around said dielectric material in mutually opposing directions at angles of between about 10 and about 20 degrees with respect to the axis of said conductor; and other of said conductor components each including a metallic conductor covered by a second dielectric material including a thermoplastic co-polyester elastomer, the ratio of the sum of the cross sectional areas of said first and second dielectric materials and said inner and outer jackets with respect to the sum of the cross sectional areas of said metallic conductors and said metallic shield being about 10 or less.

10. A coil cord as claimed in claim 1, wherein said one of said conductor components, including a metallic conductor along a conductor axis surrounded by a dielectric material which in turn is surrounded by a metallic shield covered by an inner jacket, forms an antenna.

11. A coil cord as claimed in claim 1, wherein said outer jacket is formed of PEBAX thermoplastic elastomer.

12. A coil cord as claimed in claim 1, wherein at least one of said plurality of conductor components includes a third dielectric material formed of HYTREL co-polyester elastomer.

* * * * *